United States Patent [19]

Paynton

[11] 4,118,690

[45] Oct. 3, 1978

[54] ELECTRICAL HAZARD INDICATOR

[76] Inventor: William C. Paynton, 100 Towne St., Attleboro Falls, Mass. 02763

[21] Appl. No.: 659,816

[22] Filed: Feb. 20, 1976

[51] Int. Cl.[2] ..... G08B 21/00

[52] U.S. Cl. ..... 340/656; 339/14 P; 339/113 R; 324/51; 340/635; 340/687

[58] Field of Search ..... 340/252 P, 255; 339/14 P, 113 R, 91 R, 94, 176 P, 184 R, 184 M; 324/51, 133

[56] References Cited

U.S. PATENT DOCUMENTS

| | | | |
|---|---|---|---|
| 3,176,219 | 3/1965 | Behr | 324/51 |
| 3,317,825 | 5/1967 | Huff | 324/51 |
| 3,383,588 | 5/1968 | Stoll et al. | 324/51 |
| 3,967,195 | 6/1976 | Averitt et al. | 324/51 |

FOREIGN PATENT DOCUMENTS

| | | | |
|---|---|---|---|
| 705,956 | 3/1954 | Great Britain | 339/14 P |

*Primary Examiner*—John W. Caldwell, Sr.
*Assistant Examiner*—Daniel Myer
*Attorney, Agent, or Firm*—Leitner, Palan, Martin & Bernstein

[57] ABSTRACT

An indicator device having a single indicator which is momentarily activated during connection of the device, i.e. to a power source, to indicate availability of electrical power and operability of the indicator device and then subsequently deactivated to indicate safe electrical service to an electrical appliance or tool, cord, receptacle, etc.

17 Claims, 10 Drawing Figures

FIG. 1
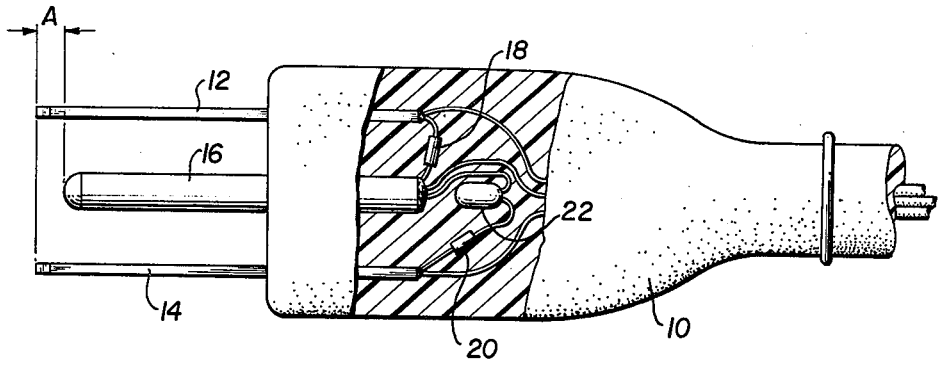
FIG. 2
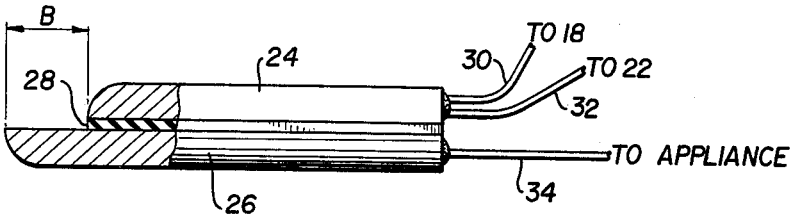
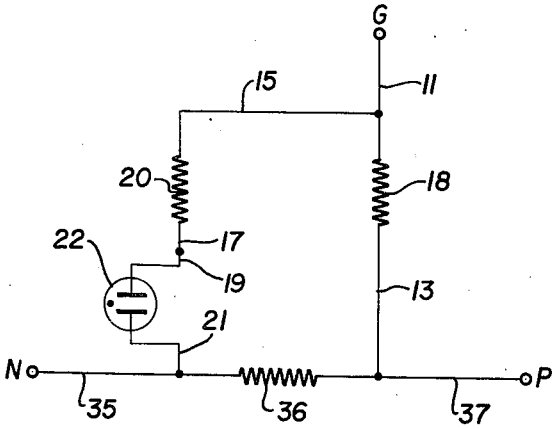
FIG. 3

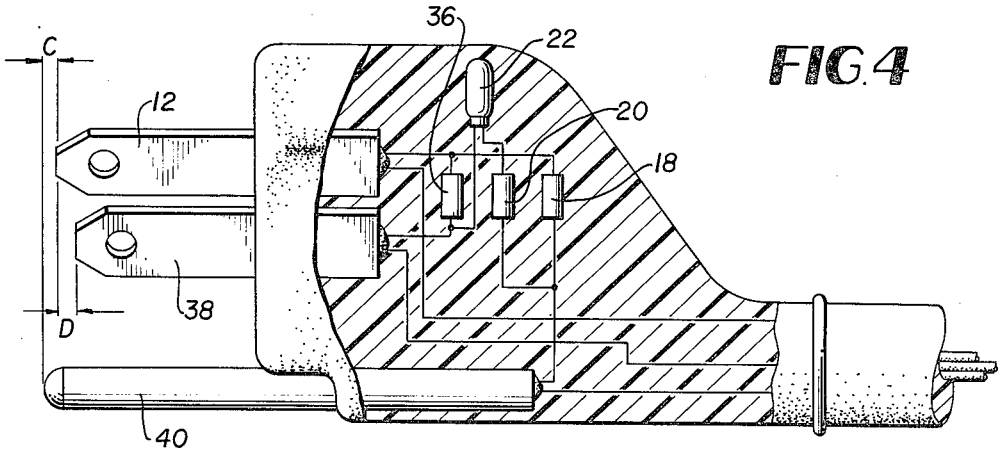
FIG. 4
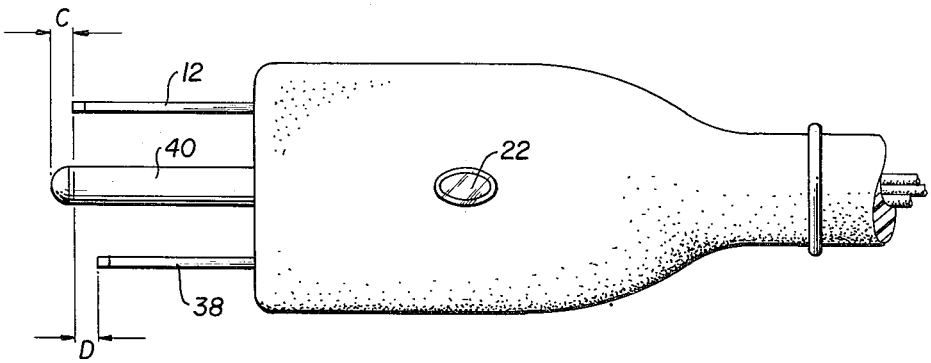
FIG. 5
FIG. 7
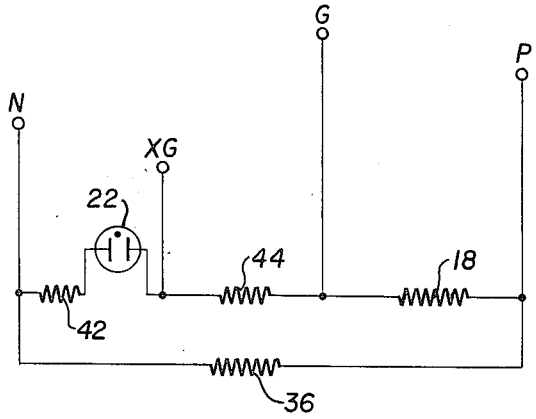
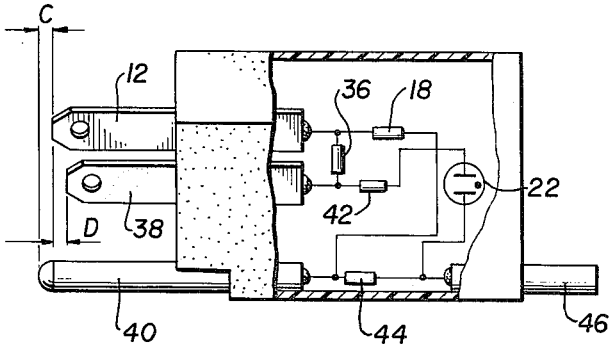
FIG. 8

FIG. 6
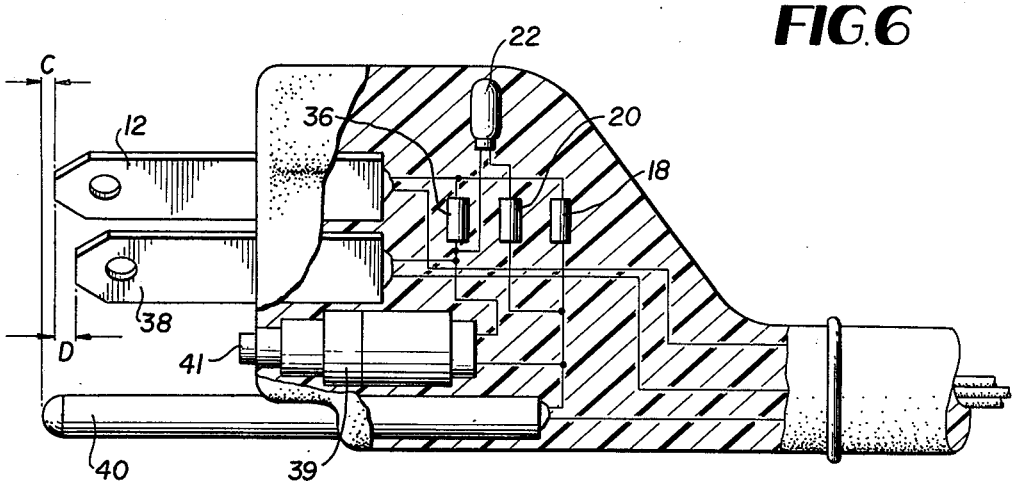
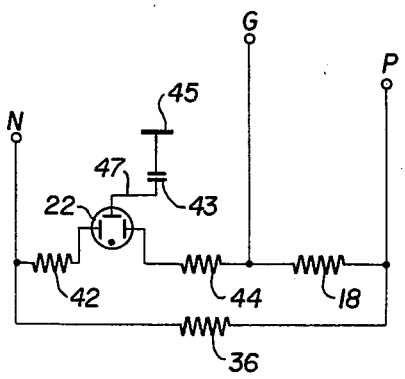
FIG. 9
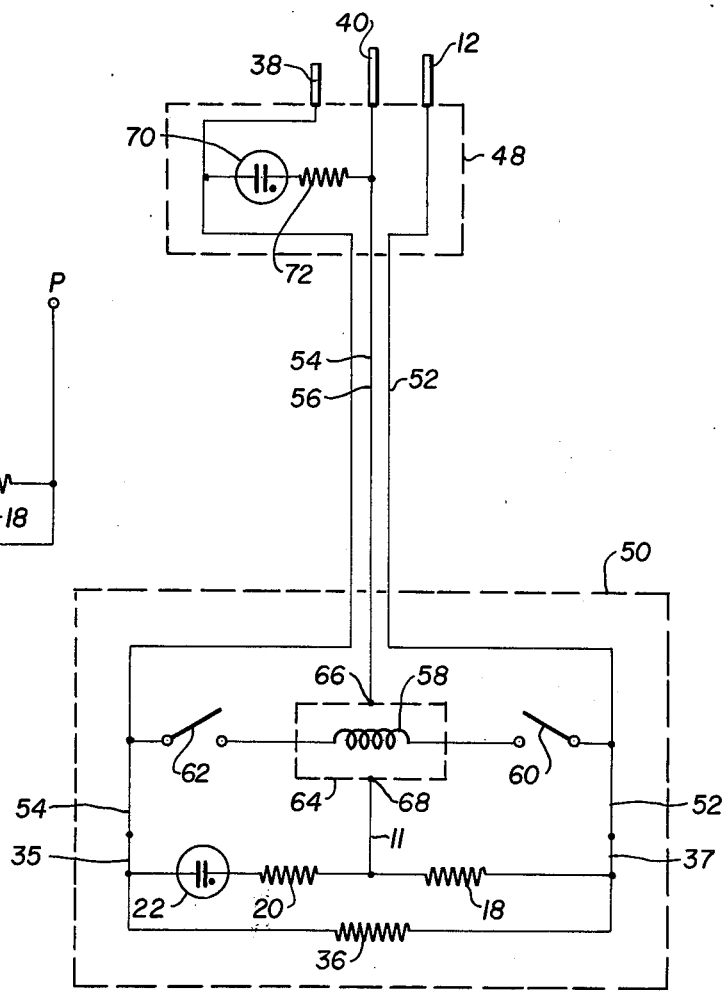
FIG. 10

ELECTRICAL HAZARD INDICATOR

BACKGROUND OF THE INVENTION

1. Field of the Invention

This invention relates generally to electrical indicators and more specifically to an electrical hazard indicator for use with a three-wire electrical apparatus or system.

2. Description of the Prior Art

The National Safety Council records hundreds of electrical shock accidents annually and many home/industrial electrocution accidents caused in whole or in part by non-grounded electrical power tools and applicances. Additionally, a severe shock hazard exists when power tools and appliances are in use during an electrical storm where an over-voltage or a power line short circuit may inadvertently charge the frame of the equipment with a potentially lethal voltage.

With the increased use of electrical monitoring equipment in hospitals, there is an increased need for properly grounded equipment. For example, heart patients have a multitude of monitors attached to their bodies and an ungrounded piece of equipment could cause electrical power to be transmitted through the monitoring equipment to the patient. Also, in the hospital environment, electrical noise and defective data may be generated by improperly grounded equipment.

Most modern equipment now feature an internal ground by use of a third grounding cable contained in the power cord set. In older homes, offices, or industrial facilities where the electrical receptacle lacks a proper ground opening or lug, the use of an adapter plug socket connector provides electrical power to the equipment which may not afford any degree of ground protection. Some of the adapter wire plugs feature a green coded ground with a connector lug that may be connected beneath the cental threaded screw that attaches the receptacle cover plate to the electrical receptacle. The National Safety Council points out that most people neglect to make the required connection even if provided for reasons such as "lack of an available screwdriver", "in a hurry", "didn't understand what the wire was for", etc.

All adapter-plug sockets exhibit a common troublesome problem for user, that being that when connected between the equipment connector and the electrical receptacle, the resulting combination tends to sag and pull away from the electrical receptacle due to the weight or movement of the appliance cord set. This often results in an electrical "open" as the male prong pulls free of the receptacle with the appliance losing power or arcing and pitting occurring within the electrical receptacle. Similarly, though the two power prongs may remain in electrical contact with the electrical receptacle, the ground prong may come loose from the receptacle and not make the proper electrical ground.

Based on the various types of plugs to be used in a multitude of types of electrical receptacles, it becomes increasingly important that the portable equipment being used is properly grounded. As described above, the lack of the ground may be caused by the use of an adapter to connect a three-prong electrical connector to a two-aperture electrical receptacle. Also, a lack of ground may occur because the electrical receptacle, into which the plug is inserted, is not properly grounded. Mere visual inspection of the receptacle and/or the plug at the end of a cord set and its mating with the electrical receptacle will not guarantee nor tell the user that the portable electrical appliance being used is properly grounded.

Ground indicators of the prior art have generally involved a light in series with a resistor connected between the positive or hot line and ground. This indicator will remain lighted as long as there is power on the hot line and the grounded line is grounded. The continuous burning of the light to indicate ground shortens the useful life of the ground indicator; the indicator is valueless after the light has burned out. A replaceable ground light would tend to increase the size and cost of the device and thus make it inconvenient and unattractive to the general public. A typical example of this type of grounding indicator is shown in U.S. Pat. No. 2,731,629.

In response to this problem, U.S. Pat. No. 3,890,030 provided an electrical plug and tester with a ground indicator therein to be activated and display a lack of ground when, for example, the plug is inserted into a wall receptacle. The circuit includes a resistor connected in series between a first prong of the plug which is adapted to be connected to a hot or positive power line; and the grounding prong, which is adapted to be connected to the receptacle's ground; and an indicator connected in series between a second prong of the plug which is adapted to be connected to a neutral or return power line of the wall receptacle; and the ground prong.

U.S. Pat. No. 3,890,030, though being an advance in the state of the art, is limited in the number of hazardous conditions it can detect and no provision is made for conveniently testing the integrity of the indicator. To detect an increased number of hazardous conditions, prior art devices have provided either two indicators, i.e., one between hot and ground and one between neutral and ground, or three indicators, i.e., one between each of the three lines. The user, upon placing one of these plural indicator devices in an electrical receptacle, must observe the condition of each of the plural indicators and then interpret the numerous combinations of on-off conditions to determine the operability or safe condition of the electrical receptacle. These plural indicator devices are used as testers by electricians to indicate specific, limited types of circuit malfunctions. To the general appliance user, i.e., the housewife and weekend handyman, plural indicators requiring interpretation are confusing and consequently prone to be ignored or misinterpreted. Thus, there exists a need for a single indicator which will tell the average user to disconnect the equipment because the electrical service is improperly connected and presents a potentially hazardous situation.

A major problem with indicators which are activated only when a hazard exists is that they are not failsafe. If the indicator is inoperative, it cannot be activated to indicate a hazard. This is not a problem with indicators that are normally activated for safe conditions, since deactivation indicates a hazard as well as an inoperative indicator, In annunciators, a test switch is provided to test the operability of the indicator. Not only would a test switch make an electrical plug or cord set attached to equipment cumbersome, the average user will not make the pretest of the indicator, either because of forgetfulness or inconvenience. Thus there exists a need for a hazard indicator which is automatically tested.

SUMMARY OF THE INVENTION

The present invention is an electrical hazard indicating device which includes an automatic test of the indicator during connection of the device to a power source. The hazard indicating device includes a housing having at least a positive, neutral and ground electrical conductor for insertion into corresponding terminals in an electrical receptacle. An indicator circuit within said housing includes an indicating means connected between the neutral and ground electrical conductor which is normally deactivated during safe electrical conditions. The neutral or ground electrical conductor extends beyond the housing a shorter distance than the remaining two electrical conductors thereby causing the indicator means to be momentarily activated during insertion of the device into an electrical receptacle thereby automatically testing the integrity of the indicator means.

Three possible indicator circuits may be automatically tested using the shorter electrical conductor. One indicator circuit, including only one indicator means between neutral and ground and a resistance between ground and positive, is automatically tested using a shorter length ground conductor. Another indicator circuit, including a single indicator means between neutral and ground, and resistance between ground and positive, and a resistance between neutral and positive, is automatically tested using either a shorter length ground or neutral conductor. A third indicator circuit, having a second ground electrical conductor connected to a verified ground or an antenna through a large impedance and including an indicator means between neutral and second ground, a resistance between both grounds, a resistance between positive and neutral, is automatically tested using either a shorter length ground or neutral.

Instead of a shorter length ground, the ground electrical conductor may be composed of two elements, electrically insulated from each other, one being of longer length and the other of shorter length. The two resistances and single indicating means of the indicator circuit may be preassembled so that the normal leads of the electrical elements provided only three output terminals for mounting to the positive, negative, and ground prongs of a plug or tester. The indicating means may be a plunger in the face of the plug and electrically actuated for the conditions which activate the indicating means to physically disconnect or eject the plug from the hazardous electrical receptacle. The indicator circuit may be included in electrical equipment, i.e., tool or appliance having the ground output terminal connected through the chassis or casing ground thereby indicating the safety of the equipment, its cord set, and the electrical receptacle.

OBJECTS OF THE INVENTION

An object of the present invention is to provide a device which indicates a hazardous electrical condition of electrical equipment, i.e., tool, appliance, receptacle.

Another object of the invention is to provide electrical equipment having an economical, attractive, and easy to use hazardous indicator therein.

A further object of the invention is the provision of electrical equipment having a single indicator therein which is lighted to indicate a hazardous condition Still another object of the present invention is to provide a hazard indicator having an automatic test of indicator operability.

An even further object of the present invention is to increase the number of electrically hazardous conditions detectable by a single indicator circuit.

A still further object of the present invention is to provide a tester capable of categorically detecting up to sixty improper conditions of an electrical service to an electrical equipment.

Another object of the present invention is to provide an indicator circuit which may be separately assembled and readily connected to the electrical conductors of electrical equipment, i.e., adapter for a plug.

An even further object of the present invention is to provide electrical equipment which automatically disconnects or ejects itself from a defective electrical service.

A still even further object of the present invention is to provide an indicator circuit which may be connected to electrical equipment to simultaneously indicate hazardous conditions of either/or the appliance or tool, its cord set, the electrical receptacle or the electrical service to which the connections are made.

Other objects, advantages, and novel features of the present invention will become apparent from the following detailed description of the invention when considered in conjunction with the accompanying drawings.

BRIEF DESCRIPTION OF THE DRAWINGS

FIG. 1 is a cutaway top view of an embodiment of the self-testing hazard indicator of the present invention;

FIG. 2 is a side view of a modified ground conductor;

FIG. 3 is an electrical schematic of another embodiment of the hazard indicator of the present invention;

FIG. 4 is a cutaway perspective view of the hazard indicator of FIG. 3 embodied in an electrical plug;

FIG. 5 is a top view of the electrical plug of FIG. 4;

FIG. 6 is a cutaway perspective of still another embodiment of the hazard indicator circuit of the present invention embodied in an electrical plug;

FIG. 7 is an electrical schematic of even another embodiment of the hazard indicator of the present invention;

FIG. 8 is a cutaway perspective of the hazard indicator of FIG. 7 embodied in an electrical testing device;

FIG. 9 is a modified electrical schematic of the hazard indicator of FIG. 7; and FIG. 10 is a schematic representation of the circuit of FIG. 3 in an electrical appliance or tool.

DESCRIPTION OF THE PREFERRED EMBODIMENTS

As shown in FIG. 1, one embodiment of the present invention provides an automatic test for the indicator device of the type shown in U.S. Pat. No. 3,890,030 and comprising a plug 10 having a positive or hot prong 12, a negative prong 14, and a ground prong 16 embedded therein. Connected between positive prong 12 and ground prong 16 is a resistor 18, and connected in series between ground prong 16 and neutral prong 14 is a resistor 20 and an indicator 22, for example, a light. The indicator 22 is normally deactivated when the plug is inserted into a normally wired outlet and becomes activated upon a loss of ground contact. The improvement to the circuitry of U.S. Pat. No. 3,890,030 is the incorporation of an automatic test of the indicator 22. In order to test the integrity or operability of indicator 22, the present invention momentarily simulates a lack of ground.

This is produced by making the ground prong 16 extend beyond the body of the plug a shorter distance than positive prong 12 and neutral prong 14. The difference in extended length, as illustrated in FIG. 1, and referenced by A, may be as small as one-tenth of an inch. The acutal length of all three prongs may be equal and positioned before molding so that the ground prong extends a shorter distance beyond the plug.

When the plug of FIG. 1 is initially inserted into an electrical receptacle, the positive terminal 12 and the neutral terminal 14 will complete a circuit through resistor 18, indicator 22, and resistor 20 to activate the indicator 22. Upon continued insertion of the plug, the ground prong 16 will make contact with the ground of the receptacle and the power from positive terminal 12 is directed to ground through resistor 18. Since the electrical potential between ground prong 16 and neutral prong 14 is substantially the same, no current will flow through the indicator 22. Thus, if the indicator 22 is operable, it will "flick" (single flash of light from a neon light) or be momentarily activated during the insertion of the plug into an electrical receptacle. If the electrical receptacle is properly grounded, the indicator 22 will be deactivated when the plug is totally inserted. If the electrical receptacle is not properly grounded, the indicator 22 will remain on continuously without the "flick." If there is no power in the receptacle or the indicator 22 is inoperable, it will neither flick or come on during or after insertion. Thus, if the indicator does not flick or it remains on continuously, the user of the equipment to which the plug is attached should be alerted to immediately disconnect the equipment by removing the plug.

There are sixty-four possible combinations of open connections, reversed connections, and combinations of open and reverse connections that can occur on the three terminals of an electrical service. These are summarized in Table I together with the indicator response; in this illustration, a neon light.

With the neutral being neutral or grounded, the ground being neutral or ground, and the positive being positive, the light will flicker and not stay on continuously. This provides an indication for four conditions which are not considered dangerous. An inoperative indicator will result in no light coming on and no flick. This same response will occur for (a) twentyseven combinations of open, neutral and ground, or no power connections; (b) seven possible combinations of power and opens only; (c) two combinations of the neutral terminal being open, the ground terminal being positive and the positive terminal being neutral or ground; (d) two combinations of the neutral terminal being open, the ground terminal being neutral or ground and the positive terminal being positive, no light.

If the neutral and ground are simultaneously positive and the positive is at neutral or ground, the light will flicker and not stay on continuously. The hazardous condition will appear as a normal safe condition. The remaining twenty possible combinations of positives, opens, neutrals, and grounds will provide a continuous light.

Thus, the device of FIG. 1 will provide an indication of all but six possible combinations by either being lighted continuously or not being lighted and non-flick. Of the six remaining conditions, only two--namely, the neutral and ground being simultaneously positive and the positive being at neutral and ground--are considered hazardous. It should be noted that without the flick, the first thirty-eight conditions are not distinguishable from the four safe conditions. Thus, if the user of the equipment illustrated in FIG. 1 inserts the plug into a receptacle and gets no light, not even a flick, or gets a continuous light, the plug should be removed from the receptacle and use of the equipment discontinued until the cause of the indicated defect has been remedied.

TABLE I

| Electrical Conditions at Terminals | | | Light Indications | | | |
|---|---|---|---|---|---|---|
| Neutral | Ground | Positive | Continuous | Flick | Nothing | Combinations |
| Combinations of O, N, G | | | | | | 27 |
| P or O | P or O | P or O | | | | 7 |
| O | P | N or G | | | | 2 |
| O | N or G | P | | | | 2 |
| N or G | N or G | P | | X | | 4 |
| P | P | N or G | | X | | 2 |
| All Other Combinations of | | | X | | | 20 |
| P, O, N, G | | | | | | 64 |

LEGEND
O Terminal Open
P Positive Connected
N Neutral Connected
G Ground Connected The only two unsafe conditions which would be undetected because the light would not come on continuously but would flick would be simultaneous power at the neutral and ground with the positive being at neutral and ground which conditions are highly unlikely to occur. These two conditions are basically identical and are the electrical equivalent of a normal condition (i.e., neutral at N, ground at G, and power at P). Since they are the electrical equivalent of a normal condition, no three wire device can detect this condition. For the normal condition, the neutral N and ground G are at the same potential, therefore there is no voltage across the circuit leg connected therebetween, and the potential difference between positive P and negative N is equal to the potential difference between positive P and ground G. The dangerous condition of power at N and G and ground or neutral at P will also produce no potential difference between neutral N and ground G and equal potential difference between positive P and neutral N and positive P and ground G. Thus, for an indicator circuit connected between the three prongs, the normal condition and the two undetectable hazardous conditions are electrically equivalent.

Since it may be undesirable to make the ground prong 16 shorter in length than the prongs 12 and 14 for safety reasons, namely, the appliance or tool should be grounded before any power is supplied via the other terminals, modification to the ground prong is shown in FIG. 2. The ground prong is shown as being made of a shorter portion 24 and a longer portion 26 separated by electrical insulation 28. The shorter portion 24 is connected by wires 30 and 32 to resistor 18 and indicator 22 respectively of the indicator circuit. An electrical conductor 34 connects the longer ground portion 26 to the appliance or tool to which the plug and cord set is attached. The lengths of portion 24 and 26 differ by an amount B which may be equivalent to A of FIG. 1 or even greater if it is desired that the ground portion 26 engage the ground of the receptacle before prongs 12 and 14 engage corresponding terminals in the receptacle. The modified ground of FIG. 2 may also be used in the indicator circuits of FIGS. 3 and 7 to be described hereafter.

Another indicator circuit which may use a shortened ground or the two-portion ground of FIG. 2 is illustrated in FIG. 3. In addition to the resistor 18 connected between the positive P and the ground G, and the indicator 22 and resistor 20 connected between the ground G and the neutral N, an additional resistor 36 is connected between the positive P and the neutral N. The value of resistors 18, 20, and 36 are selected such that the circuit of FIG. 3 functions substantially like the circuit of FIG. 1 with some additional features. For example, if the circuit of FIG. 3 is connected having positive potential on terminal P and neutral on terminal N, and an open ground, the current from positive to ground will be divided into two parallel paths, one being through resistor 18, resistor 20, and indicator 22, and the other path being through resistor 36. This is different than prior art devices which selected the values of the resistors between each terminal such that the combination of two resistors will not provide sufficient current to activate the indicator in their circuit while the current through a single resistor is sufficient to activate its indicator. These circuits usually include an indicator between each terminal whereas the present device includes only a single indicator.

A tabulation of the sixty-four occurrences for the circuit of FIG. 3 is Table II.

As can be noted, the first thirty-four combinations of events are similar to that of Table I, namely, that no light or flick will occur. If the neutral is at neutral or ground, the ground is at neutral or ground, and the positive is at positive, the light will not come on continuously, but will flick. This is also the same as in Table I. The hazardous combination of the neutral and the ground at positive and the positive at neutral or ground will also provide a flick but not provide a continuous light. The remaining twenty-four events will provide a continuous light. Thus, the main difference between Table I and II is that four additional events which provided no light and no "flick" using the circuitry of FIG. 1 will now provide a continuous light in the circuitry of FIG. 3. As in Table I, if the user does not see any "flick" indicating either an hazardous condition, nonoperative indicator, or no power on the terminals, or observes a continuous light, the plug should be removed from the receptacle and the equipment properly serviced.

The indicator circuit of FIG. 3 has a major advantage over that of FIG. 1 in that it is not necessary to use the short length ground prong 16 of FIG. 1 or the two-piece ground prong of FIG. 2. As illustrated in FIGS. 4 and 5, the circuit of FIG. 3 may be embodied in a plug with a positive prong 12 and neutral prong 38 and ground prong 40. The ground prong 40 is

TABLE II

| Electrical Condition at Terminals | | | Light Indications | | | |
|---|---|---|---|---|---|---|
| Neutral | Ground | Positive | Continuous | Flick | Nothing | Combinations |
| Combinations of O, N, G | | | | | X | 27 |
| P or O | P or O | P or O | | | X | 7 |
| N or G | N or G | P | | X | | 4 |
| P | P | N or G | | X | | 2 |
| All Other Combinations of P, O, N, G | | | X | | | 24 |
| | | | | | | 64 |

longer than the positive prong 12 by a distance C and the positive prong 12 is longer than the neutral prong 38 by a distance D. The configuration shown in FIGS. 4 and 5 are the safest in that the ground prong 40 is longer than the neutral and positive prongs 38 and 12, such that it is inserted into the receptacle first. By making neutral prong 38 shorter than ground prong 40 and positive prong 12 the automatic testing is provided, i.e., a lack of neutral condition is present which will make the device "flick" upon insertion into a normal electrical receptacle.

Based on the present Underwriter Laboratories' requirements and depending upon the voltage and amperage the plug is desiged to carry, the neutral prong extends beyond the body of the plug between 0.625 to 0.717 inches; between 0.687 to 0.749 inches; or between 1.187 to 1.280 inches. These numbers are based on the Underwriter Laboratories' requirement of minimum length of the neutral or positive prong, maximum length of the ground prong, and minimum separation of the neutral and positive prong from the ground prong. As these requirements change, the specific distance of separation and the length of the prongs may change. The main requirement of the present invention is that the ground prong of FIG. 1 or neutral prong of FIG. 4 be shorter than the remaining two prongs so as to momentarily indicate a failure and thereby momentarily activating the indicator 22 such that the indicator's reliability is automatically tested during the insertion of the plug into an electrical receptacle.

A plug may be designed not meeting Underwriter Laboratories' requirements which would provide an additional safety feature. For a safe electrical receptacle, the indicator could be designed to stay activated until the plug is inserted far enough into the electrical receptacle so that a child could not get his or her fingers between the plug and the receptacle. This could be accomplished by reducing the extended length of the neutral prong 38. Thus, the user would insert a plug into an electrical receptacle until the indicator is deactivated, signifying that the plug is safely or completely inserted.

Although the indicator circuits of FIGS. 1 and 3 are shown as embodied in plugs, it should be noted that these indicator circuits may be provided in any equipment or wire having three electrical conductors; for example, it could be a tester, installed in a hand tool, or an extension cord, etc.

For economical and reliability considerations, it is desirable to preassemble the electrical elements of the indicator circuit before attaching the circuit to the three electrical conductors (P.N.G) to equipment such as a plug, tester, or appliance. By preassembly, the circuit may be pretested before being included in the equipment. Also, the preassembly would facilitate retrofitting the indicator circuit to existing equipment i.e., plugs, etc. FIG. 3 illustrates a method of assembling the indicator circuit so as to provide three output terminals which are readily attached to the three electrical conductors of the equipment. Lead 11 of resistor 18 provides one output terminal while lead 13 is connected to lead 37 of resistor 36. Lead 37 and 35 of resistor 36 provide the remaining two output terminals. Lead 17 of resistor 20 is connected to lead 19 of the indicator 22, and lead 15 of the resistor 20 is connected to lead 11 of resistor 18. Lead 21 of indicator 22 is connected to lead 35 of resistor 36.

The specific connections shown in FIG. 3 are not the only possible connections which provide the required three output terminal configurations. For example, lead 15 of resistor 20 may be an output terminal while lead 11 of resistor 18 is connected to lead 15. The essence of the indicator circuit is that the individual legs of the circuit be interconnected and that only one of the two leads at the interconnection be the output terminal.

Prior art devices usually attach each lead individually to the prongs of a plug. This not only increases the time required for assembly of the plug but also reduces reliability of the finished plug. If the circuit is not properly connected, it must be disassembled from the plug or the total plug discarded. The present method of assembly allows testing of the circuit before attaching it to the plug or tester.

In addition to the indicator 22, an ejector may be provided in a plug to automatically eject the plug from an electrical outlet for all hazardous conditions which will activate the indicator 22. As illustrated in FIG. 6, an electrical ejector 39 having a plunger 41 in the face of the plug is connected in parallel with indicator 22 and its series resistor 20. The ejector may be a solenoid for driving the plunger 41 or an electrothermal actuator such as those available from Gould Inc., Actuator Systems Division, Willoughby, Ohio. The device of FIG. 6 is designed to physically eject the plug from a hazardous electrical receptacle even if the user ignores or overlooks the indicator 22. The ejector should be activated by the continuous hazard signal and not the momentary activation used to automatically test the indicator 22. It should be noted that the ejecting mechanism may also be used in place of indicator 22.

To provide an indicator which indicates all unsafe or hazardous conditions of an electrical receptacle, the circuitry of FIG. 3 is modified as shown in FIG. 7. The indicator circuit of FIG. 7 has the resistor 18 between the positive or hot P and the ground G, and the resistor 36 between the positive or hot P and the neutral N. As a variance to the circuit of FIG. 3, the circuit of FIG. 7 has an additional external ground line XG. A resistor 42 in series with indicator 22 is connected between the neutral N and the new external ground XG and resistor 44 is connected between the new external ground XG and the original ground G.

The modification of the circuitry of FIG. 3 provides additional indication as noted in Table III. Before discussing the changes in Table III it should be noted that the device of FIG. 7 is initially used as the circuitry of FIG. 3 without the connection of the external ground. Thus initially, the indications are still the same. After the indicator has been inserted into a receptacle and "nothing", "flick", or "light on continuously" conditions have been indicated, the external ground is connected to a verified ground and additional indication of "light on continuously" is provided for some of the previously "nothing" and "flick" conditions.

As can be seen from Table III, the additional indications provided are a continuous light for the seven combinations of power and opens, which were previously indicated as nothing and the unsafe conditions of power on neutral, power on ground and neutral or ground on power, which were indicated in

TABLE III

| Electrical Conditions at Terminals | | | Light Indications | | | |
|---|---|---|---|---|---|---|
| Neutral | Ground | Positive | Continuous | Flick | Nothing | Combinations |
| Combinations of O, N, G | | | | | X | 27 |
| N or G | N or G | P | | X | | 4 |

TABLE III-continued

| Electrical Conditions at Terminals | | | Light Indications | | | |
|---|---|---|---|---|---|---|
| Neutral | Ground | Positive | Continuous | Flick | Nothing | Combinations |
| All Other Combinations of P, O, N, G | | | X | | | 33<br>64 |

Tables I and II by a "flick" and no continuous light. Thus the circuitry of FIG. 7, as illustrated in Table III, provides no indication for twenty-seven combinations of opens, neutral and grounds (indicating no power) and for an inoperative indicator. Four safe conditions are indicated by the light flickering and not being on continuously, i.e., the neutral and ground are at neutral or ground and the positive is positive. Similarly, all other of the remaining thirty-three unsafe conditions are indicated by a continuous light. Thus the indicator circuit of FIG. 7 provides a true electrical hazard indicating device with an automatic validity test of the indicator.

As shown in FIG. 8, the circuitry of FIG. 7 may be provided in a housing having electrical conductors 12, 38, and 40 extending from one face and an electrical conductor 46 extending from another face. The additional electricl conductor 46 may be connected by, for example, an extension cord to an electrical receptacle whose ground has been verified or may be attached to a known earth ground, for example, a water pipe. As noted for the previous embodiments, the indicator circuitry of FIG. 7 may be embodied in a plug and connected to a cord set and electrical appliance or may be connected directly to equipment such as a portable tool.

For the average user, the connection of electrical conductor 46 to a verified ground is inconvenient. Thus the circuit of FIG. 7 is modified, as illustrated in FIG. 9 to include an impedance in series with a third electrode 47 of a three electrode indicator. The impedance is a capacitor 43 connected to a conductive plate 45. The value of capacitor 43 (for example 0.001 microfarads) is chosen to have a very high impedance at sixty cycles. Instead of capacitor 43, a large resistor, for example, one megohm may be used. The value of the external ground impedance is selected to limit the current to the conductive plate 45 if either the neutral N or ground G is powered.

By using a three electrode neon bulb as indicator 22, a person touching plate 45 functions as an antenna. Thus instead of attaching the conductor 46 of FIG. 8 to a verified ground, a person need only touch conductor plate 45 to give the same extra indications for the two hazardous conditions of neutral N and ground G being powered and positive P at neutral or ground. The plate 45 may be an external prong as 46 or a plate exposed along a surface of a plug or tester housing. As with the operation of the circuit of FIG. 7, the conductive plate 45 must be touched after the device is inserted and a first ground of indications are observed.

In FIGS. 1, 4, and 6, the indicator circuits have been illustrated as being embodied in a plug. The circuits of FIGS. 1, 3, 7 and 9 are equally applicable to use with an appliance, tool, or equipment as illustrated in FIG. 10. A plug and cord set 48 having positive prong 12, shortened neutral prong 38 and ground prong 40 is connected to an appliance or tool 50 by wires or conductors 52, 54, and 56. The load 58, illustrated as a motor coil of a tool, is connected between power conductor 52 and neutral conductor 54 by switches 60 and 62. The chassis 64 is connected to ground conductor 56 and 66 and to ground output terminal 11 of the indicator circuit at 68. The other two output terminals 37 and 35 are connected to conductors 52 and 54 respectively. An additional indicator 70 and resistor 72 are connected between the neutral prong 38 and ground prong 40 in the plug 48.

The operation of the circuit of FIG. 10 (ignoring the indicator 70 and resistor 72) is the same as that for the circuit of FIG. 3, except that the indications given are for the electrical service, the electrical receptacle, the cord set 48 and the tool 50, not just the electrical receptacle as described for the embodiment of FIG. 4. If the chassis 64 is not properly grounded or the cord set is defective, indicator 22 will provide an appropriate indication. It should be noted that indicator 22 will flick as required.

The indicator 70 in the plug provides additional information to that of indicator 22. Indicator 70, using resistor 36, could flick and then remain deactivated, indicating that the electrical receptacle is safe, and indicator 22 could be activated, indicating, for example, that the chassis 64 is ungrounded. Thus the two indicators 22 and 70 will isolate the problem to the tool 50. To provide total information about the electrical receptacle, the plug 48 may contain a three resistor indicator circuit in addition to the indicator circuit in the tool 50. Indicators 22 and 70 are neon bulbs, as illustrated; the bulbs 22 and 70 must be electrically matched and their respective resistors 20 and 72 must be of the same value so that both indicators will be activated simultaneously.

The circuits of FIGS. 1, 3, 6, 7, and 9 may be provided in a two-terminal to three-terminal receptacle adapter. In addition to the indications given, the indicator will remain activated until the ground lug is connected to the ground of the two-terminal receptacle through the cover plate screw. Thus the present device will remind the user of the adapter to make the required ground lug connection.

The circuit of FIG. 3 could be considered as a three module circuit with each leg (i.e., 20–22, 18, 36) comprising a module. These modules may be placed remote from each other and still provide hazardous indications if properly electrically connected. The circuit of FIG. 10 illustrates this principle by having leg 70–72 remote from legs 18 and 36. The indicator 22 of all the illustrated embodiments may be considered an indicator means with its series resistor and instead of being a light may be an audible or any other visual indicator as well as the ejector or circuit disconnector illustrated in FIG. 6. Preferably, the indicator 22 is a neon light having 5,000 hours M.T.B.F. (mean time between failures). Typical examples of values of resistors 18 and 36 are 625,000 ohms, resistor 20 being 39,000 ohms and resistors 42 and 44 being 39,000 ohms. The resistances are chosen to limit the leakage current to 200 microamps while not significantly reducing the brilliance of the light 22. Similarly, the values of resistor 20 and 36 are selected to protect and extend the life of the light 22 while providing enough brilliance during the flick. The resistive values are only an example and any value of resistors may be chosen which will perform the required enumerated functions.

The notation of positive, neutral, and ground are merely relative and are to be understood to represent conventional references of electrical receptacle wiring. For example, positive may include hot, powered or the active line of a three terminal outlet. Similarly, the plug or tester may include more than three prongs to test electrical receptacles having more than three terminals. The three wires may carry direct current as well as alternating current in excess of and less than 125 volts.

It is obvious from the description of the preferred embodiments that the objects of the present invention have been obtained in that an electrical hazard indicator is provided which automatically tests the operability of a normally off indicator during insertion of the electrical equipment connector plug into an electrical outlet. The device has been displayed and described as a plug or tester in a housing or in a tool. Although the invention has been described and illustrated in detail, it is to be clearly understood that the same is by way of illustration and example only and is not to be taken by way of limitation, the spirit and scope of the invention being limited solely by the terms of the appended claims.

What is claimed:

1. In a plug having a positive prong, a neutral prong, and a ground prong, a first fixed resistive path between said positive and said ground prongs, and an indicator means including a glow discharge indicator connected between said neutral and said ground prongs, the improvement comprising:

a second fixed resistive path between said positive and said neutral prongs; and said neutral prong extending exterior of said plug a shorter distance then said positive and ground prongs whereby said indicator means is momentarily activated when said plug is inserted into a correctly wired electrical receptacle.

2. The plug of claim 1 wherein said indicator means is the only indicator in said plug and includes a resistor in series with a light.

3. In a plug having a positive prong, a neutral prong, and a ground prong, and an indicator circuit connected between said positive, neutral, and ground prongs, the improvement comprising:

said indicator circuit includes three paths interconnecting said prongs, two of said paths are fixed resistance and a third path includes a glow discharge indicator;

said neutral prong extending beyond said plug a shorter length than said ground and positive prongs whereby glow discharge indicator in said indicator circuit is momentarily activated when said plug is inserted into a correctly wired electrical receptacle.

4. The plug of claim 3 wherein said indicator circuit includes one of said fixed resistance paths connected between said positive and ground prongs, another of said fixed resistance paths connected between said neutral prongs, and said glow discharge indicator is connected between said neutral and ground prongs.

5. An electrical hazard indicator comprising:

a first electrical conductor adapted to be connected to a normally positive point in an electrical system;

a second electrical conductor adapted to be connected to a normally neutral point in said electrical system;

a third electrical conductor adapted to be connected to a normally ground point in said electrical system;

a fourth electrical conductor adapted to be connected to a verified ground point;

a first resistor connected between said first and said second electrical conductors;

a second resistor connected between said first and said third electrical conductors;

a third resistor connected between said third and said fourth electrical conductor and an indicator means connected between said second and said fourth electrical conductors for indicating electrical hazards in said electrical system.

6. The electrical hazard indicator of claim 5 wherein said first, second, and third electrical conductors extended from said indicator so that said first and said third electrical conductors will make contact with said electrical system before said second electrical conductor, whereby said indicator means is only momentarily activated when said first electrical conductor is connected to a positive point, and when said second and third electrical conductors are connected to a neutral or ground point in said electrical system.

7. A tester for an electrical receptacle having at least a positive terminal, a negative terminal, and a ground terminal comprising:

a housing having a first face;

first, second, and third electrical conductors traversing said face, and being arranged so as to be inserted in said positive, negative, and ground terminals respectively;

an indicator circuit in said housing being connected to said first, second, and third electrical conductors and including a glow discharge indicator means connected between said second and said third electrical conductors and fixed resistances connected between said first and second conductors and between said first and third conductors; and said second electrical conductor extends outside said housing a shorter distance than said first and third electrical conductors for causing said glow discharge indicator means to be momentarily activated during the insertion of said tester into said receptacle.

8. The tester of claim 7 wherein said glow discharge indicator means indicates all possible unsafe conditions of said electrical receptacle by not being initially momentarily activated and subsequently unactivated except said negative and said ground terminals being positive simultaneously with said positive terminal being negative or ground.

9. The tester of claim 8 wherein said indicator circuit includes a first fixed resistance connected between said first and said second electrical conductors and a second fixed resistance connected between said first and said third electrical conductors, and wherein said glow discharge indicator means is the only indicator in said indicator circuit and includes a glow discharge bulb and a fixed third resistance.

10. The tester of claim 7 wherein said tester includes a fourth electrical conductor connected to said glow discharge indicator means adapted to be electrically connected to a verified ground and said glow discharge indicator means indicates all operable safe conditions of said electrical receptacle and operability of said glow discharge indicator means by being initially momentarily activated and subsequently unactivated when the tester first is inserted in an electrical receptacle and subsequently said fourth electrical conductor is connected to a verified ground.

11. The testor of claim 10 wherein said indicator circuit includes a first resistance connected between said first and said second electrical conductors, a second resistance connected between said first and said third electrical conductors, and a third resistance connected between said third and said fourth electrical conductors; and wherein said glow discharge indicator means is the only indicator in said indicator circuit and includes a glow discharge bulb and a fourth resistance.

12. An electrical indicator circuit comprising:

a glow discharge indicator means having a first and second leads;

a first fixed resistance having a first and second leads;

a second fixed resistance having a first and second leads;

said first leads of said glow discharge indicator means and said first resistance being connected together with one of said first leads providing a first output terminal;

said second leads of said indicator means and said second resistance being connected together with one of said second leads providing a second output terminal;

said first lead of said second resistance and said second lead of said first resistance being connected together with one of these leads of said first and second resistances providing a third output terminal; and said first, second, and third output terminals being adapted to connect the indicator circuit to three electrical conductors of a tester.

13. The electrical indicator of claim 12 wherein said first output terminal is designated to be connected to a neutral conductor of a tester, said second output terminal is designated to be connected to a ground conductor of a tester and said third output terminal is designated to be connected to a positive conductor of a tester.

14. In an electrical device having a load, a grounded housing for said load, a first and second electrical conductors connected to said load, a third electrical conductor connected to said housing and a plug having first, second, and third prongs connected to said first, second and third conductors respectively, the improvement comprising:

an indicator circuit in said electrical device connected to said first and second electrical conductors and said grounded housing and including a glow discharge indicator means connected between said second electrical conductor and said grounded housing, a fixed resistance path connected between said first and second electrical conductors and a fixed resistance path connected between said first electrical conductor and said grounded housing; and said second prong extends outside said plug a shorter distance than said first and third prongs for causing said glow discharge indicator means to be momentarily activated during the insertion of said plug into an electrical receptacle.

15. The electrical device of claim 14 wherein said indicator circuit includes a first fixed resistance connected between said first and said second electrical conductors and a second fixed resistance connected between said first electrical conductor and said grounded housing, and wherein said glow discharge indicator means is the only indicator in said indicator circuit and includes a glow discharge bulb and a third resistance.

16. The electrical device of claim 14 including a second indicator means in said plug connected between said second and said third prongs.

17. The tester of claim 7 wherein said glow discharge indicator means is a three electrode glow discharge bulb having two of said electrodes connected to said second and third electrical connectors and an impedance is connected in series with the third electrode and said third electrode comprises an antenna.

* * * * *

UNITED STATES PATENT AND TRADEMARK OFFICE

CERTIFICATE OF CORRECTION

PATENT NO. : 4,118,690

DATED : October 3, 1978

INVENTOR(S) : William C. Paynton

It is certified that error appears in the above-identified patent and that said Letters Patent are hereby corrected as shown below:

Column 1, line 46, after for insert --the--.

Column 2, line 61, after indicator delete "," and insert --.--

Column 3, line 28, Delete second occurrence of "and" and insert therefor --a--.

Column 5, line 10, Delete "acutal" and insert --actual--.

Column 10, line 25, Delete "electricl" and insert --electrical--

Column 12, line 27, Delete "then" and insert --than--.

Signed and Sealed this

*Thirtieth* Day of *January 1979*

[SEAL]

*Attest:*

RUTH C. MASON
*Attesting Officer*

DONALD W. BANNER
*Commissioner of Patents and Trademarks*